United States Patent [19]

Metz et al.

[11] Patent Number: 5,056,968

[45] Date of Patent: Oct. 15, 1991

[54] DEVICE FOR COUPLING A ROD FOR DRILLING A TAPHOLE

[75] Inventors: Jean Metz, Luxembourg; Severino Venturini, Obercorn, both of Luxembourg

[73] Assignee: Paul Wurth S.A., Luxembourg

[21] Appl. No.: 538,208

[22] Filed: Jun. 14, 1990

[30] Foreign Application Priority Data

Jun. 30, 1989 [LU] Luxembourg ..... 87546

[51] Int. Cl.[5] ..... B23B 31/10; F27D 3/15

[52] U.S. Cl. ..... 408/239 R; 266/271; 279/28

[58] Field of Search ..... 408/238, 236, 237; 266/271, 45; 279/20, 28, 60, 79, 89, 4, 82

[56] References Cited

U.S. PATENT DOCUMENTS 3,862,750 1/1975 Broom ..... 266/271
4,227,682 10/1980 Ulveling et al. ..... 408/237
4,589,636 5/1986 Bäumer et al. ..... 266/271
4,682,780 7/1987 Kurama et al. ..... 279/79
4,893,794 1/1990 Maillet ..... 266/271

FOREIGN PATENT DOCUMENTS 2520857 8/1983 France ..... 279/79

*Primary Examiner*—William Briggs
*Attorney, Agent, or Firm*—Fishman, Dionne & Cantor

[57] ABSTRACT

The device includes a chuck designed to be secured to a working tool and which has a front cavity for receiving an end of a drilling rod and a gripping device for fastening the end of the rod in this cavity. The gripping device is actuated by pneumatic or hydraulic pistons, sliding in a cylindrical chamber closed at the rear by a plug. In order to avoid rapid wear of this plug, a spring is arranged between the said plug and the adjacent face of the piston, the spring being strong enough to keep the piston away from the plug.

3 Claims, 1 Drawing Sheet

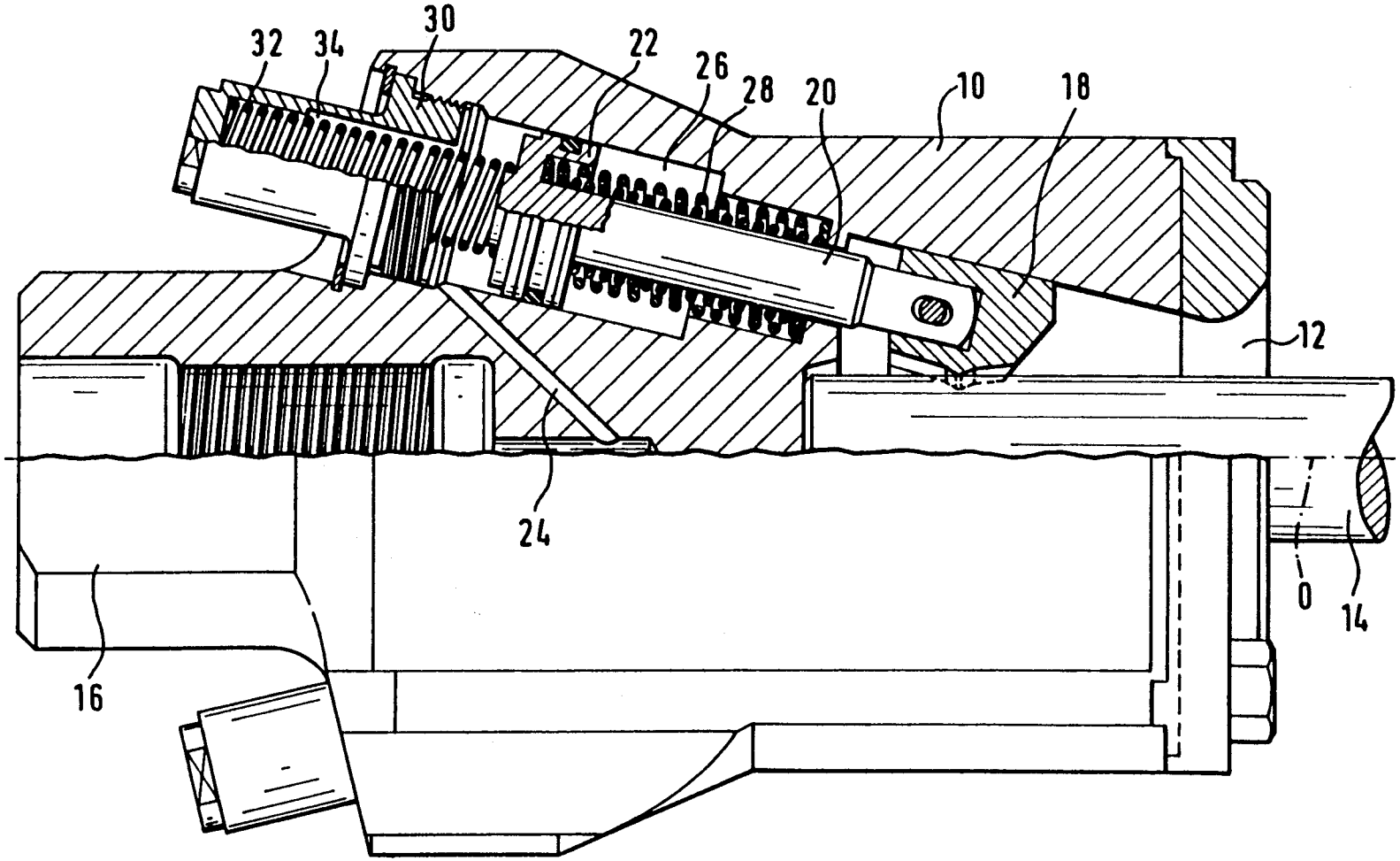
14
12
0
18
10
20
28
26
22
24
30
34
32
16

DEVICE FOR COUPLING A ROD FOR DRILLING A TAPHOLE

TECHNICAL FIELD

The present invention relates to a device for coupling a rod for drilling the taphole of a shaft furnace to the working tool of a drilling machine.

Devices for coupling a rod for drilling a taphole of a shaft furnace to the working tool of a drilling machine for the implementation of a process according to which the closure and opening of the taphole comprise an operation for positioning and an operation for extracting the drilling rod which is left in the taphole mass between two successive tappings are known. Such devices typically include a chuck to be secured to the working tool and having a front reception cavity for receiving the end of the drilling rod and a gripping device for fastening the end of the said rod in this cavity. The gripping device typically includes at least two sliding rods arranged symmetrically about the axis of the cavity and each carrying, at one end, a jaw intended to grasp the end of the rod and, at the opposite end, a piston subjected, on the one hand, to the action of a pneumatic or hydraulic fluid in order to close the gripping device by penetration of the jaws into the rod and, on the other hand, to elastic means which act in such a way as to open the gripping device, each of the pistons sliding in a sealed cylindrical chamber closed at the rear by a plug.

A device of this type is known from French Patent No. 2,520,857. The working tool generally consists of a pneumatic percussion means capable of striking in both directions so as to drive the drilling rod into the plugging mass before the latter has hardened and in order to be able to extract it therefrom during the opening of the taphole. The pneumatic fluid used for the percussion means may also be used to close the gripping devices during the extraction of the drilling rod, whereas during the engagement of the drilling rod, the pneumatic chamber of the piston of the gripping device is aerated to permit the opening of these gripping devices under the action of their elastic means.

During the engagement of the drilling rod in the plugging mass, the percussive action of the percussion means causes, as counter-reaction and as result of the inertia of the gripping devices, vibrations of the said rod which leads to hammering of the plug by the pistons. It is for this reason that a rapid deterioration of these plugs as well as of their thread and of those of the chuck is found.

SUMMARY OF THE INVENTION

The object of the present invention is to provide an improved device of the type described in the background which does not have these disadvantages.

In order to achieve this aim, the device proposed by the present invention is essentially characterized by a spring arranged between the plug and the adjacent face of the piston, the said spring being strong enough to keep the piston away from the plug counter to the action of the said elastic means to which it is exposed on the opposite face.

The plug preferably, has a cylindrical cavity for accommodating the spring.

BRIEF DESCRIPTION OF THE DRAWINGS

Other features and characteristics will emerge from the detailed description of an advantageous embodiment given below by way of illustration, with reference to the single figure which shows diagrammatically a longitudinal section through a coupling device such as that proposed by the invention.

DETAILED DESCRIPTION OF THE INVENTION

The device comprises a chuck 10 provided with a front cavity 12 for receiving the free end of a drilling rod 14 and with a rear axial bore 16 for receiving the percussion means of a working tool (now shown).

As in the abovementioned document, the device comprises a gripping device for grasping the front end of the rod 14. This gripping device consists of two jaws arranged symmetrically about the longitudinal axis of the chuck 10 and sliding obliquely relative to this axis 10. One of these jaws is shown by the reference 18, whereas the other, which is not visible, is identical to that which is shown and functions in the same way. The jaw 18 is mounted on the front end of a rod 20 and is guided by the inner surface of the cavity 12. The rod 20 extends into a cylindrical chamber 26 where it is integral with a piston 22. This piston 22 is, in the example shown, a pneumatic piston which is subjected, on the opposite side to the rod 20, to the action of a pneumatic fluid which enters the chamber 26 via a conduit 24. Situated around the rod 20 are one or more helical springs 28 which bear, on the one hand, on the piston 22 and, on the other hand, on an inner flange of the pneumatic chamber 26. The pressurizing of the chamber 26 via the pneumatic conduit 24 causes the jaw 18 to advance until it penetrates into the surface 0 the rod 14, so that a movement to the right of the chuck 10 carries along the rod 14. In contrast, the aeration of the chamber 26 subjects the piston 22 to the action of the spring 28 in order to release the jaw 18 from the rod 14. This is, for example, the case during the engagement of the rod 14 in the mass for plugging the taphole.

The end of the pneumatic chamber 26 is closed with the aid of a plug 30 which may be simply screwed, in a sealed manner, into the chuck 10. In order to avoid the hammering of this plug by the piston 22 as a result of the counter-reaction to which is is subjected during the action of the percussion means when the rod is engaged in the taphole, the invention proposes to arrange in spring 32 between the piston 22 and the plug 30. This spring 32 is strong enough to oppose, in part, the action of the spring 28 and to keep, when the chamber 26 is aerated, the piston 22 away from the inner surface of the plug 30 and thus avoid the hammering of the plug 30 by the piston 22.

According to another characteristic of the present invention, the chuck 10, unlike the known chucks, is a machined one-piece chuck which contributes to a longer life since it does not comprise any connecting screws and bolts which are generally very susceptible to the recurrent percussions.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A device for coupling a rod for drilling the taphole of a shaft furnace to a drilling apparatus, comprising:

a coupling member;

means for securing the coupling member to the drilling apparatus;

means for securing the coupling member to the drilling rod, said means for securing the coupling member to the drilling rod comprising;

a cavity, defined within the coupling member and extending along a longitudinal axis, for receiving an end of the drilling rod, and gripper means for gripping the end of the drilling rod, said gripper means comprising:

at least two gripper rods slidably mounted within the coupling member and arranged symmetrically about the longitudinal axis of the cavity, each of said gripper rods comprising a jaw for grippingly engaging the drilling rod, said gripper rods each having a first position wherein the jaw grippingly engages the drilling rod to secure the end of the drilling rod within the cavity and a second position wherein the jaws are displaced from the drilling rod;

first resilient means for urging the gripper rods into the second position;

pneumatic means for urging each of the gripper rods into the first position, said pneumatic means comprising:

a sealed chamber, closed at one end by a plug, a piston slidably received within the chamber, means for supplying fluid to the chamber, and second resilient means, disposed between said plug and said piston, for urging said piston away from the plug counter to the action of the first resilient means.

2. The device of claim 1, wherein a cylindrical cavity is defined within the plug for receiving the second resilient means.

3. The device of claim 1, wherein the coupling member comprises a one-piece chuck.

* * * * *

UNITED STATES PATENT AND TRADEMARK OFFICE

CERTIFICATE OF CORRECTION

PATENT NO. : 5,056,968

DATED : October 15, 1991

INVENTOR(S) : JEAN METZ ET AL

It is certified that error appears in the above-identified patent and that said Letters Patent is hereby corrected as shown below:

ON THE TITLE PAGE

The title should be deleted and replaced with --DEVICE FOR COUPLING A ROD FOR DRILLING THE TAPHOLE OF A SHAFT FURNACE TO THE WORKING TOOL OF A DRILLING MACHINE--.

Column 1, line 2-3, the title should be deleted and replaced with --DEVICE FOR COUPLING A ROD FOR DRILLING THE TAPHOLE OF A SHAFT FURNACE TO THE WORKING TOOL OF A DRILLING MACHINE--.

Column 3, line 8, delete ";" and insert --:-- in its place.

Signed and Sealed this

Sixth Day of April, 1993

*Attest:*

STEPHEN G. KUNIN

*Attesting Officer*

*Acting Commissioner of Patents and Trademarks*